United States Patent [19]

Wolf

[11] Patent Number: 4,692,747

[45] Date of Patent: Sep. 8, 1987

[54] ARTICLE SECURITY SYSTEM

[75] Inventor: Albert E. Wolf, Philadelphia, Pa.

[73] Assignee: Checkpoint Systems, Inc., Thorofare, N.J.

[21] Appl. No.: 886,418

[22] Filed: Jul. 17, 1986

[51] Int. Cl.[4] ..... G08B 13/24

[52] U.S. Cl. ..... 340/572; 186/52; 186/59; 186/60; 186/61; 340/551

[58] Field of Search ..... 340/572, 551, 568; 186/52, 60, 61, 59

[56] References Cited

U.S. PATENT DOCUMENTS 4,583,083 4/1986 Bogasky ..... 340/572

*Primary Examiner*—Glen R. Swann, III

*Attorney, Agent, or Firm*—Alfred Stapler

[57] ABSTRACT

A person desiring to check out articles protected by security tags deposits these articles at one end of a check-out aisle. From there, they are transported to the opposite end of the check-out aisle as part of the check-out procedure. The person who deposited the articles is restrained from accompanying these articles all the way through the check-out aisle, but is able to reach its opposite end only via a path which is separate from the check-out aisle itself. That separate path is equipped with an electronic article surveillance system. The same separate path and its associated electronic article surveillance system serve several check-out aisles.

10 Claims, 2 Drawing Figures

FIG. 1
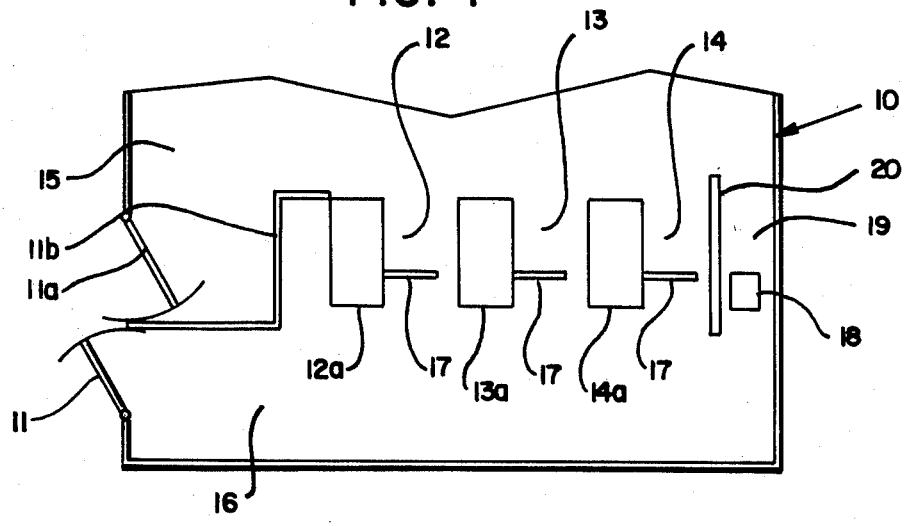
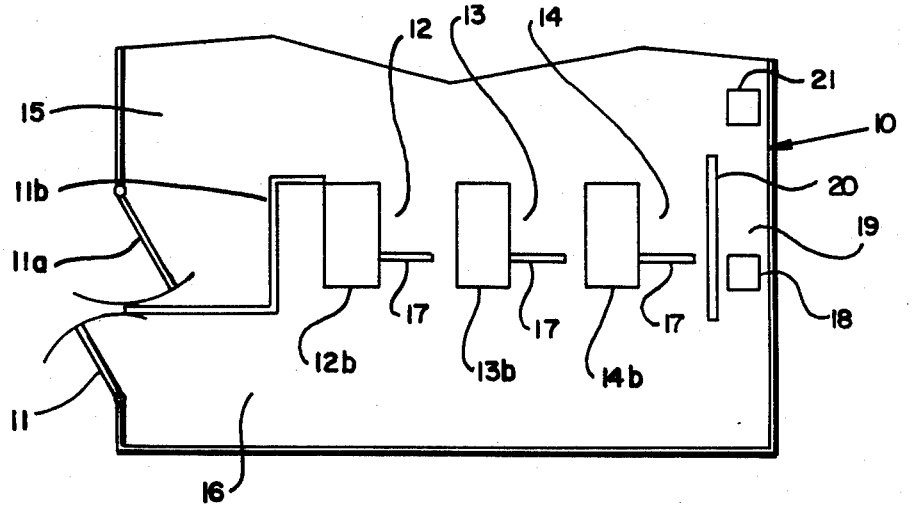
FIG. 2

ARTICLE SECURITY SYSTEM

BACKGROUND OF THE INVENTION

This invention relates to so-called electronic article surveillance systems, and particularly to such systems which are especially useful in their application to stores in which the checking out of merchandise takes place via a multiplicity of check-out aisles.

Electronic article surveillance (and its acronym "EAS") is the general term which has become commonly used to designate a variety of techniques employed to electronically detect the unauthorized removal of merchandise from a store.

EAS is practiced by means of a variety of different detection systems. However, these systems all have in common two essential components. One component is some form of special security tag affixed to each piece of merchandise which is to be protected from unauthorized removal. The other component is some form of electronic equipment which is capable of detecting the proximity of one of the special security tags. For example, the tag may be provided with an electrical circuit which is configured so as to be resonant at a particular radio frequency, and the detecting equipment may be in the form of two antennas, one radiating electrical signals in a band of frequencies which includes said resonant frequency and the other receiving these signals. These antennas are positioned on opposite sides of a check-out aisle. When merchandise with such a tag attached passes between the antennas, the received signals are distorted by the tag's presence; electronic signal processing circuity connected to the receiving antenna senses this distortion and triggers an alarm.

In the presence of such an EAS system, it obviously becomes necessary to distinguish between merchandise whose removal is authorized (e.g. because it has been paid for) and that which is not. The EAS system itself is not inherently capable of making that distinction. It causes an alarm when a security tag is detected, regardless of the authorized or unauthorized state of the article.

One way to deal with this situation has been to disable the tag at the time that the corresponding item of merchandise becomes authorized for removal. In the radio-frequency system example given previously, this can be accomplished either by physically removing the tag at the time the merchandise is properly checked out, or by electronically deactivating the tag at that time, so that its subsequent passage between the antennas ceases to be detectable by the EAS system.

An entirely different approach is to leave the security tag in place and undeactivated and provide two separate paths for exiting from the store, one for the authorized merchandise, and the other for the customer. The customer exit path leads through the EAS system (e.g. between the two radio-frequency system antennas), while the merchandise exit path does not. In practice, this involves providing a check-out aisle at one end of which the merchandise is deposited before the customer passes through the EAS system installed in the aisle. The customer then passes through that system on the way to the opposite end of the check-out aisle, whereas the merchandise is moved along the aisle on a path which parallels the customer's path but does not pass through the EAS system. The customer then retrieves the merchandise and leaves. In this way, any alarm from the EAS system is presumptively attributable to the presence of tagged merchandise still in the possession of the customer, rather than having been properly checked-out. By such separation of paths, the distinction can readily be made between properly checked-out merchandise and any which is being removed (whether intentionally or not) without proper check-out.

In stores in which there are multiple check-out aisles, such as supermarkets which typically feature a row of several such aisles (sometimes as many as 10, 20, or even more) it has been the practice to install a separate EAS system in each aisle.

More recently, it has been proposed to substantially reduce the cost of using EAS systems to protect stores having multiple check-out aisles by establishing a traffic pattern in the check-out and exit areas which would make it possible to greatly reduce the number of separate EAS systems needed.

To that end, it has recently been proposed to dispense with the installation of separate EAS systems in the individual check-out aisles, and to install only a single EAS system, at a common store exit location, through which all customers must pass, after having passed through their respective check-out aisles and paid for their purchases.

This type of arrangement is proposed, for example in U.S. Pat. No. 4,583,083 issued Apr. 15, 1986.

Such a proposal is superficially very attractive, because it would save the cost of multiple EAS system installations. An EAS system currently costs on the order of several thousand dollars. Therefore, savings of multiples of that amount could be realized by that proposal, both in initial equipment and also in continued maintenance, updating, etc. Moreover, particularly in supermarkets, it is already conventional to provide a single passageway, crossing the outlet ends of the individual check-out aisles, and leading to a common exit door. It is at this common exit door that it was proposed to place the single EAS system.

Although attractive from the standpoint of reduced EAS system costs, that proposal also had some ramifications which significantly detract from its potential advantages. First, unlike in those (conventional) prior arrangements which have a separate EAS system in each check-out aisle, in the arrangement proposed in said U.S. Pat. No. 4,583,083 it is no longer possible to permit the customer to regain possession of the checked-out merchandise at the check-out aisle itself. If that were permitted, then the customer would again have possession of tagged merchandise when passing through the EAS system stationed at the common exit door. Therefore, an alarm would occur even though this merchandise had been properly checked out and thus authorized for removal from the store. Moreover, the presence of such authorized merchandise at the EAS-equipped exit would mask the potential presence of unauthorized merchandise. In other words, each exiting customer would create a false alarm; conversely, valid alarms would be masked by these false alarms.

The cure for this problem seems rather obvious: provide some other way to transport this checked-out merchandise out of the store, and give it back to the customer only after the customer has passed through the single EAS system at the common exit door. Unfortunately, that is easier said than done. There are only two ways to perform the merchandise transport required. One is by store employees assigned to that task (that is the way proposed in said U.S. Pat. No. 4,583,083). The other is by mechanical equipment, such as conveyors and the like. The use of employees turns this into a labor-intensive situation, which can easily more than offset the savings due to the reduced number of EAS systems. For example, in a supermarket having 10 check-out aisles, the annualized savings from using only one EAS system at the exit door, rather than a separate one at each check-out aisle, could be on the order of $10,000. Even one additional employee needed to perform the merchandise transport function required by said U.S. Pat. No. 4,583,083 could easily offset that saving. In practice, one employee could not serve 10 aisles in this way, without creating serious delays in customer departures. Mechanical equipment, for transport without human intervention, would manifestly be still more costly.

Moreover, provisions would have to be made for reliably reuniting each customer with that customer's specific merchandise beyond the exit door. In a busy store, with any given customer's purchases often in several separate bags, this could easily lead to mass confusion and dissatisfaction.

Looked at from a different perspective, that proposed arrangement would deprive the store—especially the supermarket—of one of its more important economic advantages, which is that the customers, rather than store personnel or expensive machinery, perform virtually all merchandise handling and transport functions.

Thus, what superficially looked like a very attractive proposal in reality is fraught with problems, which threaten to nullify its practical usefulness.

Accordingly, it is an object of the present invention to overcome the drawbacks of the recently proposed arrangement discussed above.

It is another object to provide an arrangement which retains the cost saving of reducing the number of EAS systems relative to the number of check-out aisles, without creating the need for merchandise transport by store employees or by mechanical means.

It is still another object to provide such an arrangement which is highly flexible and adaptable to a variety of store exit traffic patterns.

It is still another object to provide such an arrangement which is simple and inexpensive to implement.

It is still another object to provide such an arrangement which requires minimal departures from currently conventional check-out structures and procedures.

SUMMARY OF THE INVENTION

These and other objects which will appear are achieved in accordance with the present invention as follows. With the exceptions noted below, a conventional multi-aisle check-out arrangement is used. Its several check-out aisles all face at one end toward the store interior, and at the other end toward a common passageway, which in turn leads to the store exit. In such a conventional arrangement, the merchandise is transported from one end of the check-out aisle to the other during the check-out procedure. The customer is able to accompany the merchandise all the way through the aisle and retrieve the merchandise at the passageway end. In accordance with the present invention, the merchandise still moves from one end to the other of the check-out aisle, but the customer does not accompany it all the way to the retrieval end. Rather, means are provided to cause the customer to essentially reverse direction and reenter the interior of the store adjacent to the check-out aisles, i.e. the same area of merchandise display and selection from which the customer had originally approached the check-out aisles. From that interior area, there is then provided a path which also leads to the common passageway, but which is separate from any of the check-out aisles. This separate path is equipped with an EAS system, whereas the check-out aisles, themselves, are not. Through this separate EAS-equipped path, and the common passageway to which it leads, the customer is able to return to whichever check-out aisle that same customer had used, but now at the end of that aisle which faces toward the common passageway. There, the customer's checked-out merchandise is waiting for retrieval and subsequent removal by the customer through the store exit.

BRIEF DESCRIPTION OF THE DRAWING

For further details reference is made to the discussion which follows, in light of the accompanying drawings wherein FIG. 1 is a diagrammatic illustration of an arrangement constituting a preferred embodiment of the present invention; and FIG. 2 is a diagrammatic illustration of an alternative embodiment.

The same reference numerals are used to designate similar elements in the two figures.

DESCRIPTION OF THE PREFERRED EMBODIMENTS

Referring to FIG. 1, this is a layout diagram of a portion of a typical supermarket in the vicinity of the exit from the store. In this diagram, the reference numeral 10 designates the overall store boundary. A door 11 is provided, which serves as the exit for customers. An adjoining door 11*a* serves as the entrance, with an internal barrier 11*b* preventing the mixing of entering and exiting traffic. A set of check-out aisles 12, 13 and 14 is defined by their respective check-out counters 12*a*, 13*a* and 14*a* and the space in front of each of those counters. One end of each aisle 12, 13 and 14 faces the store interior. The other end faces a common passageway 16 which joins these aisle ends to each other and to exit 11. In the arrangement diagrammed in FIG. 1, the clerks (not shown) serving these check-out aisles are positioned on the left-hand sides of the respective counters 12*a*, 13*a* and 14*a*, while the customers position themselves along the right-hand sides of counters 12*a*, 13*a* and 14*a*.

In accordance with the present invention, barrier 17 is provided in each check-out aisle 12, 13 and 14. These barriers 17 are so constructed and arranged that a customer can no longer conveniently reach merchandise placed on a given checkout counter by that same customer, once that merchandise has been processed by the check-out clerk and has been moved toward the end of the counter facing common passageway 16. Such barriers 17 are not present in conventional store layouts. It should be noted that some conventional check-out aisles include what appear to be such barriers formed by swinging gates which are part of EAS systems associated with these aisles (see the above-referenced U.S. Pat. No. 4,583,083). However, the purpose of such prior-art gates was not to bar the customer from ultimately passing completely through the check-out aisle. In contrast, that is the purpose of each barrier 17 in FIG. 1.

Further in accordance with the present invention, the check-out aisles themselves are not equipped with their own EAS systems. Rather, a single EAS system 18 serves all three check-out aisles 12, 13 and 14. In this respect, the present invention resembles the proposal described in said U.S. Pat. No. 4,583,083. However, unlike in said Patent, that single EAS system 18 is not located at the store exit, but rather along a separate path 19 leading from the merchandise display and selection area 15 to the common passageway 16.

Thus, in order to ultimately exit from the store, all customers must first pass through the same path 19. In so doing, they will all be subjected to the operation of the EAS system 18 associated with path 19, and this will occur while they are separated from the merchanidse which they have previously deposited at the respective check-out counter. Consequently, an alarm given by EAS system 18 will presumably be due to merchandise which is in the possession of a customer without having been subjected to proper check-out.

Once through path 19, each customer uses common passageway 16 to return to the same check-out aisle 12, 13 or 14 which had been used by that particular customer. There, that customer's merchandise is waiting, at the end of that aisle which faces the common passageway 16. The customer is now free to retrieve the waiting, checked-out merchandise and take it out of the store via common passageway 16 and exit door 11.

It will be recognized that numerous advantages are achieved by the arrangement of FIG. 1. Specifically, EAS is used to examine all customers leaving the store, but only one EAS system 18 is needed to service several check-out aisles 12, 13 and 14. The general pattern of store layout remains very similar to that heretofore used. Only one additional path 19 needs to be created. This path 19 may be relatively narrow, since it serves primarily for the unimpeded passage of one customer at a time, without merchandise. Thus, this additional path 19 consumes little floor space within the store. Another advantage is that the check-out clerks no longer need to react to EAS alarms, as is the case when each check-out aisle has its own EAS system. Rather, this task can be concentrated in a single person, stationed at or near the EAS system 18 associated with path 19. This path 19 may be suitably placed in relation to other store functions to facilitate the performance of that task, e.g. close to the store manager's position.

Best of all, the desired reduction in numbers of EAS systems used in the store is achieved without having to resort to the use of additional store personnel or of complicated mechanisms to reunite properly checked-out merchandise with the customer who purchased it.

The individual components of the arrangement illustrated in FIG. 1 may take various conventional forms.

The check-out aisles 12, 13 and 14 may be of any conventional type, including, for example, a cash register, a conveyor belt for moving the merchandise past the check-out clerk, a merchandise accumulation area at the end of the aisle facing common passageway 16, provisions for facilitating bagging, and so forth, all as appropriate to the type of merchandise being processed.

The barrier 17 which is associated with each check-out aisle 12, 13 or 14 may also take any desired form, suitable for performing its simple function of separating the customer from the properly checked-out merchandise, until after the customer has passed the EAS system 18 associated with path 19. If the store using the present invention is one in which shopping carts are customarily utilized, then the barrier 17 may be placed high enough to prevent the passage of people, while permitting the shopping cart which brought the merchandise to the check-out aisle to pass beneath the barrier. In that way, this shopping cart again becomes available to the customer for use in ultimately retrieving the merchandise and removing it from the store via passageway 16 and exit door 11.

If safety regulations prohibit the use of a barrier 17 which completely bars the way to people, then that barrier can be made yielding, e.g. in the form of a spring-loaded swinging arm. Indeed, in some cases, the barrier 17 may be intangible, in the form of a sign which instructs the customer to not proceed beyond a given point, but to first return into the store interior 15 and then use path 19 and common passageway 16 for merchandise retrieval.

Path 19 may be defined in any practical manner, e.g. between a wall forming the store boundary 10 and a guide rail 20, as diagrammatically shown in FIG. 1, or by other path-defining structures. In any case, these structures are preferally such that the customer is able to keep the properly checked-out merchandise in view while transiting path 19 and common passageway 16.

It is also desirable that the number of check-out aisles served by a single EAS-equipped path 19 be limited sufficiently so that the traffic through that path 19 does not become congested, nor the time delay excessive between the customer's reentry into the store area 15 and return to the check-out aisle for merchandise retrieval. Therefore, as the number of check-out aisles increases, it may be necessary to provide additional paths 19, each of course equipped with its own EAS system 18. If so, these paths 19 are preferably distributed along the series of check-out aisles, so that any given check-out aisle is not more than three or four such aisles away from a path 19.

The EAS system 18 associated with path 19 may also take any of several well-known forms, e.g. that sold under the name Checkpoint Mark III, by Checkpoint Systems, Inc., of Thorofare, N.J. U.S.A.

Referring now to FIG. 2 of the drawings, this shows a store portion which has the same layout as in FIG. 1, except as explained below. In FIG. 2, the three check-out counters shown are designated, respectively, by reference numerals **12*b*, 13*b* and 14*b*. The addition of these "b" suffixes indicates that these counters are not quite the same as the check-out counters 12*a*, 13*a* and 14*a* of FIG. 1. The difference is that the counters 12*b*, 13*b* and 14*b* of FIG. 2 lack money handling facilities, such as cash registers. They have the same (or at least equivalent) keyboard and display facilities, for entering the prices and related information for the merchandise being checked-out. However, the actual payment is carried out at a separate pay station 21, which serves all three check-out aisles 12, 13 and 14. At each check-out aisle, the customer receives a print-out of the merchandise transactions, which may be similar to the so-called "tape" currently provided by cash registers. On the way to path 19, the customer then stops at pay station 21** and pays the bill on the basis of the print-out.

This centralized payment arrangement fits in well with the other features of the present invention. It provides a further substantial simplification of store procedures, as well as reducing the potential of errors which stem from having cash handling performed a teach check-out aisle by a clerk who also has a variety of other tasks to perform.

Furthermore, the embodiment of FIG. 2 lends itself well to use in conjunction with a technique which is currently being proposed, involving further automation of the check-out process. In this technique, the customer would perform personally the manipulative steps involved in checking out, using an optical scanner to read the so-called UPC code on the items of merchandise being checked out. As in FIG. 2, the customer would then proceed to a separate pay station to make payment for the accumulated purchases.

It will be understood that a variety of modifications may be made without departing from the present inventive concept.

Indeed, the invention is not limited in application to retail stores at all, but can be used in other situations with similar circumstances, e.g. in lending libaries. Accordingly, it is desired that the scope of the inventive concept be defined only by the appended claims.

I claim:

1. In a check-out system for premises having an interior area which houses articles protected against unauthorized removal from said premises, said articles having affixed thereto security tags which are detectable by an electronic article surveillance system, said premises being provided with a plurality of check-out aisles for said articles, each aisle having one end facing said interior area and an opposite end facing a common passageway connecting all of said opposite ends to each other and to an exit from said premises, the improvement which comprises:

means for barring persons desiring to remove articles from said premises via said check-out aisles from accompanying said articles through said aisles to their said opposite ends;

at least one path separate from said check-out aisles and leading from said interior area to said common passageway, through which path said persons are able to reach said opposite ends of the check-out aisles for article retrieval; and an electronic article surveillance system associated with said at least one separate path for detecting security tags carried through said separate path.

2. The system of claim 1, wherein the check-out aisles themselves do not have associated electronic article surveillance systems.

3. The system of claim 1, wherein there is a plurality of said separate paths, each having an associated electronic article surveillance system, the number of said check-out aisles being greater than the number of said separate paths.

4. The system of claim 3, wherein different ones of said separate paths are separated from each other by a plurality of said check-out aisles.

5. The system of claim 1, wherein said barring means is in the form of a physical barrier across each check-out aisle.

6. The system of claim 1, wherein said barring means is in the form of a notice prohibiting passage.

7. The system of claim 1, wherein said separate path is so constructed and arranged that persons using it can maintain visual contact with articles at said opposite ends of the check-out aisles.

8. The system of claim 1, wherein said separate path is so constructed and arranged that only one person at a time can pass by the electronic article surveillance system associated with said path.

9. The system of claim 1, wherein said premises are those of a retail store and the articles are merchandise for sale in that store.

10. The system of claim 9, wherein said check-out aisles lack provisions for payment for said merchandise, and further comprising means separate from said aisles for effecting such payment.

* * * * *